US012721445B2

(12) United States Patent
Carpentier

(10) Patent No.: US 12,721,445 B2
(45) Date of Patent: Sep. 1, 2026

(54) COMPUTER WORKSTATION

(71) Applicant: 6997732 CANADA INC., Québec (CA)

(72) Inventor: Martin Carpentier, Quebec (CA)

(73) Assignee: 6997732 Canada Inc., Quebec (CA)

( * ) Notice: Subject to any disclaimer, the term of this patent is extended or adjusted under 35 U.S.C. 154(b) by 189 days.

(21) Appl. No.: 18/817,831

(22) Filed: Aug. 28, 2024

(65) Prior Publication Data

US 2025/0072619 A1 Mar. 6, 2025

Related U.S. Application Data

(60) Provisional application No. 63/579,096, filed on Aug. 28, 2023.

(51) Int. Cl.

| | |
|---|---|
| ***A47C 7/70*** | (2006.01) |
| ***A47C 7/68*** | (2006.01) |
| ***A47C 7/72*** | (2006.01) |
| *A47B 83/02* | (2006.01) |

(52) U.S. Cl.

CPC ..... *A47C 7/723* (2018.08); *A47C 7/68* (2013.01); *A47B 2083/025* (2013.01); *A47B 2200/0076* (2013.01)

(58) Field of Classification Search

CPC ..... A47C 7/723; A47C 7/68; A47B 2083/025; A47B 2200/0072; A47B 2200/0096

See application file for complete search history.

(56) References Cited

U.S. PATENT DOCUMENTS

| | | | | |
|---|---|---|---|---|
| 4,925,240 | A | 5/1990 | Peters | |
| 5,056,864 | A | 10/1991 | Cooper | |
| 5,074,615 | A | 12/1991 | Honig | |
| 5,542,746 | A * | 8/1996 | Bujaryn | A47C 9/005 297/301.1 |
| 6,270,157 | B1 * | 8/2001 | Kapushinski | A47C 7/72 297/188.21 |
| 7,322,653 | B2 * | 1/2008 | Dragusin | A47C 7/72 297/301.2 |

(Continued)

FOREIGN PATENT DOCUMENTS

| | | |
|---|---|---|
| DE | 4105372 | 1/1992 |
| KR | 20020066691 | 8/2002 |

*Primary Examiner* — Syed A Islam

(74) *Attorney, Agent, or Firm* — Adam K. Sacharoff; Much Shelist, P.C.

(57) ABSTRACT

The present disclosure concerns a computer workstation supporting one or more computer monitors in front of a sitting user, comprising: a frame, comprising: a lower frame section supporting a user chair; a support arm having a proximal end connected to the lower frame section and a distal end projecting forward of the user chair; and a monitor stand assembly positionally adjustable relative to the lower frame section, comprising: an armrest extension projecting from the frame; a monitor mount affixed unto the armrest extension and configured to support the one or more computer monitors; and a brace having a first extremity mounted to the distal end of the support arm and a second extremity mounted to the armrest extension directly under the monitor mount. At least one of the extremities of the brace is pivotally mounted. At least one of the brace and the support arm is telescopic.

20 Claims, 10 Drawing Sheets

(56) References Cited

U.S. PATENT DOCUMENTS

| | | | | |
|---|---|---|---|---|
| 7,922,249 | B2 * | 4/2011 | Marchand | A47B 83/001 297/148 |
| 2010/0194155 | A1 * | 8/2010 | Dankovich | A47B 83/001 297/188.21 |

* cited by examiner

COMPUTER WORKSTATION

CROSS-REFERENCE TO RELATED APPLICATIONS

This application claims priority under 35 USC § 119 (e) of U.S. provisional patent application 63/579,096 filed on Aug. 28, 2023, the specification of which is hereby incorporated by reference.

TECHNICAL FIELD

The technical field relates to computer workstations, and more particularly to computer workstations having a positionally adjustable monitor mount.

BACKGROUND

When it comes to workspaces comprising computer monitors, there are a variety of tools available to increase the ergonomics of a user. For example, workstations that combine a chair or a chair mount and a monitor mount are known in the art. Typically, the monitor mount and the monitors are supported in an elevated fashion in front of a sitting user. Such devices, however, may have some drawbacks. On the one hand, monitor mount configurations providing strong support for the weight of one or more monitors are usually limited in their positional adjustability. On the other hand, workstations that do offer positional adjustability are, in turn, limited in the weight and quantity of monitors that may be supported.

In view of the above, there is a need for a computer workstation which would be able to overcome or at least minimize some of the above-discussed prior art concerns.

BRIEF SUMMARY

It is therefore an aim of the present invention to address the above-mentioned issues.

According to a general aspect, there is provided a computer workstation for supporting one or more computer monitors in front of a sitting user, comprising: a frame, comprising: a lower frame section configured to support a user chair; and a support arm having a proximal end connected to the lower frame section and a distal end projecting forward of the user chair; and a monitor stand assembly positionally adjustable relative to the lower frame section, comprising: an armrest extension projecting from the frame; a monitor mount affixed onto the armrest extension and configured to support the one or more computer monitors; and a brace having a first extremity mounted to the distal end of the support arm and a second extremity mounted to the armrest extension directly under the monitor mount, wherein at least one of the brace and the support arm is telescopic.

According to another general aspect, there is provided a computer workstation for supporting one or more computer monitors in front of a sitting user, comprising: a user chair; a frame, comprising: a lower frame section supporting the user chair; a support arm having a proximal end connected to the lower frame section and a distal end projecting forward of the user chair; and an upper frame section mounted to the lower frame section; an armrest mounted to the upper frame section; and a monitor stand assembly positionally adjustable relative to the lower frame section, comprising: an armrest extension projecting from at least one of the armrest and the lower frame section; a monitor mount affixed onto the armrest extension and configured to support the one or more computer monitors; and a brace having a first extremity mounted to the distal end of the support arm and a second extremity mounted to the armrest extension directly under the monitor mount, wherein at least one of the first extremity and the second extremity of the brace is pivotally mounted to the distal end of the support arm or to the armrest extension respectively.

According to another general aspect, the monitor stand assembly is positionally adjustable relative to the lower frame section in at least one of: upwardly, downwardly, laterally, and rotatably.

According to another general aspect, the lower frame section is supported by a ground surface and the upper frame section is pivotally mounted to the lower frame section.

According to another general aspect, the lower frame section further comprises a base subsection resting on the ground surface and a dynamic subsection supporting the user chair and pivotable about the base subsection. The support arm can project from the dynamic subsection.

According to another general aspect, the support arm comprises a first segment projecting substantially horizontally forward of the lower frame section and a second segment projecting substantially vertically and upwardly from the first segment.

According to another general aspect, the support arm projects centrally widthwise of the user chair.

According to another general aspect, the proximal end of the support arm is pivotally connected to the lower frame section.

According to another general aspect, the armrest extension comprises a first armrest extension member projecting forwardly from a proximal end and a second armrest extension member projecting from a distal end of the first armrest extension member towards a center widthwise of the user chair. At least one of the first armrest extension member and the second armrest extension member can be telescopic.

According to another general aspect, the workstation further comprises a table mounted to the armrest extension and projecting in front of the user sitting on the user chair.

According to another general aspect, the monitor mount comprises a stand projecting upwardly from the armrest extension and a monitor support connected to the stand and configured to support the one or more computer monitors. At least one of the stand can be pivotable about the armrest extension and the monitor support can be pivotable about the stand. The stand can be configurable into a locked position, and wherein at least one of the monitor mount and the stand further comprises a locking mechanism to configure the stand in the locked position. The locking mechanism can comprise one of: a hook connected to the armrest extension and an aperture defined in the stand, the hook being configured to engage with the aperture defined in the stand to configure the stand in the locked position, a handle operable by the user and configured to actuate pins engageable into corresponding apertures defined in the stand to configure the stand in the locked position, and an electric actuator configured to configure the stand in the locked position when actuated by the user.

According to another general aspect, the brace is telescopic.

According to another general aspect, the workstation further comprises a footrest connected to at least one of the support arm and the lower frame section.

According to another general aspect, the monitor mount and the brace are substantially vertically aligned.

According to another general aspect, a weight of the monitor mount and of the supported one or more monitors is fully supported by a combination of the armrest extension and the brace.

BRIEF DESCRIPTION OF THE DRAWINGS

It will be noted that throughout the appended drawings, like features are identified by like reference numerals.

DETAILED DESCRIPTION

Figure 1:
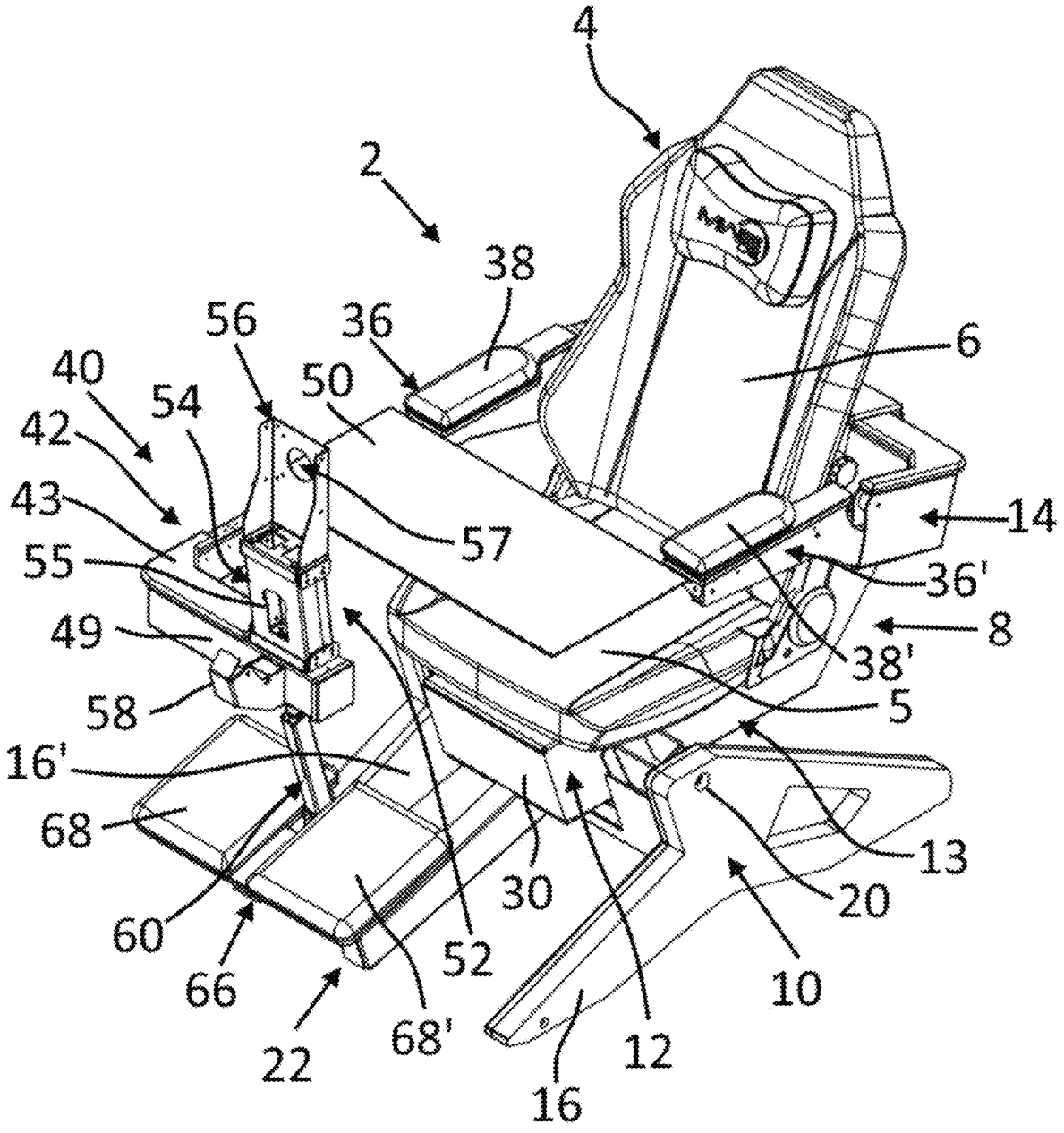
FIG. 1 is a front and top perspective view of a computer workstation in accordance with an embodiment.
Figure 2:
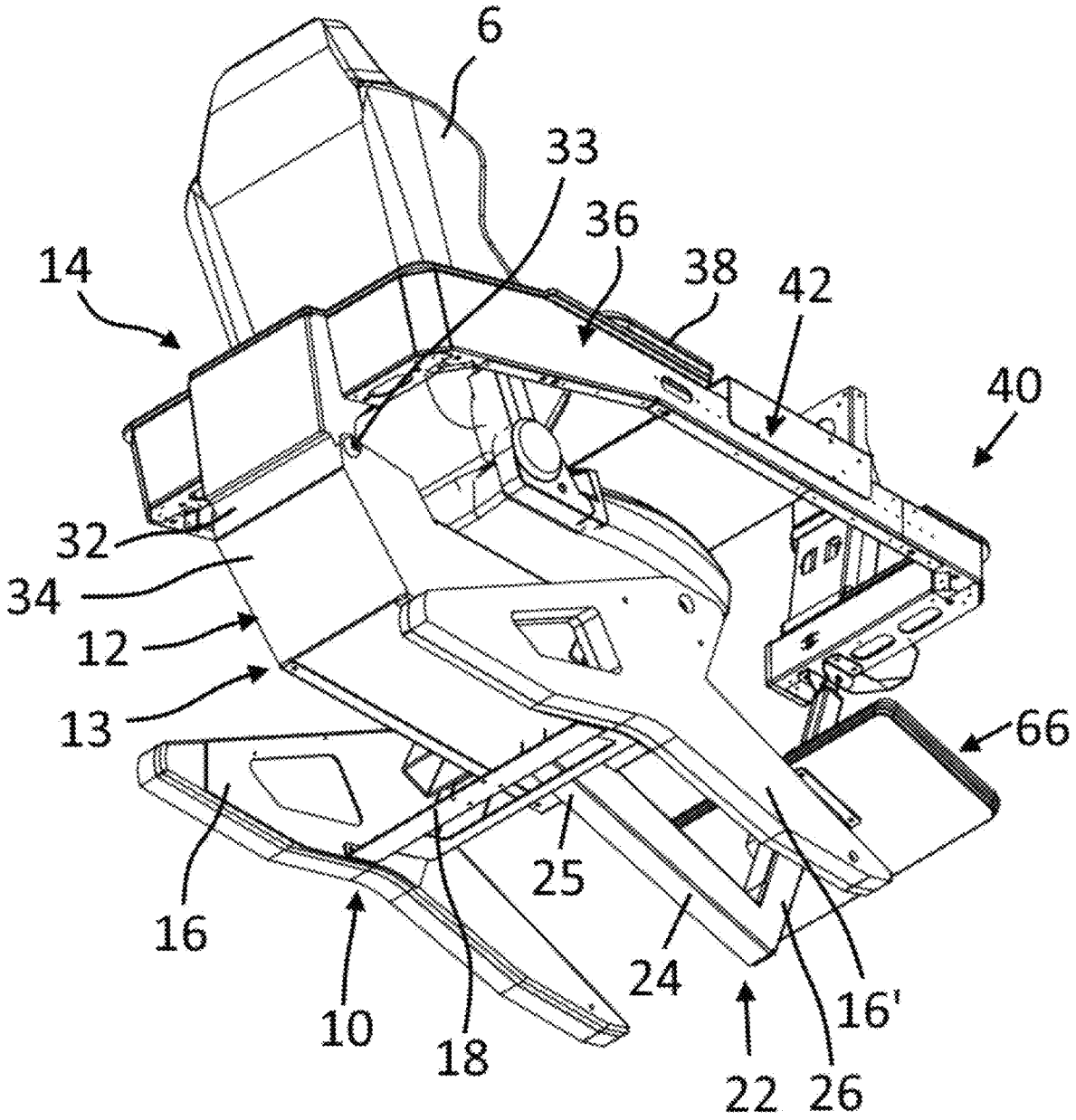
FIG. 2 is a rear and bottom perspective view of the computer workstation of FIG. 1.

In the following description, the same numerical references refer to similar elements. Furthermore, for the sake of simplicity and clarity, namely so as to not unduly burden the figures with several references numbers, not all figures contain references to all the components and features, and references to some components and features may be found in only one figure, and components and features of the present disclosure which are illustrated in other figures can be easily inferred therefrom. The embodiments, geometrical configurations, materials mentioned and/or dimensions shown in the figures are optional and are given for exemplification purposes only.

Moreover, it will be appreciated that positional descriptions such as "above", "below", "upward", "downward", "forward", "rearward" "left", "right" and the like should, unless otherwise indicated, be taken in the context of the figures only and should not be considered limiting. For example, in the specification, the term "upward" refers to an element being over a certain element whereas the term "downward" refers to an element being under the certain element. As a further example, in the specification, an element being "in front" or "forward" of a user sitting in the computer workstation may be positioned facing the user's face and an element being "behind" or "rearward" of the user may be positioned located behind the user's back.

To provide a more concise description, some of the quantitative expressions given herein may be qualified with the term "about". It is understood that whether the term "about" is used explicitly or not, every quantity given herein is meant to refer to an actual given value, and it is also meant to refer to the approximation to such given value that would reasonably be inferred based on the ordinary skill in the art, including approximations due to the experimental and/or measurement conditions for such given value. In the following description, the term "about" means within an acceptable error range for the particular value as determined by one of ordinary skill in the art, which will depend in part on how the value is measured or determined, i.e., the limitations of the measurement system. It is commonly accepted that a 10% precision measure is acceptable and encompasses the term "about".

It will be appreciated that the term "transversal", "transversally" and the like should, unless otherwise indicated, be taken in the context of an axis or direction crossing through another axis or direction. For example, a transversal axis to a longitudinal axis would imply that the transversal axis crosses through the longitudinal axis. The crossing angle may be any angle between 1 and 179 degrees, the interval being an open interval. Specific embodiments may refer to "lateral" axis, which may be taken in the context of the axis being at 90 degrees from the axis to which it is compared to; these embodiments must however be taken only in the context of said embodiments and are not limitative for the rest of the possible embodiments. The term "laterally" may however be taken in the context of "next to" or "on the side of", especially if it refers to the position of an element relative to another element. On the other hand, the term "laterally" may be taken in the context of "in the direction of the lateral axis" if it refers to the direction of a movement.

In the present description, an embodiment is an example or implementation of the computer workstation described herein. The various appearances of "one embodiment," "an embodiment" or "some embodiments" do not necessarily all refer to the same embodiments. Although various features may be described in the context of a single embodiment, the features may also be provided separately or in any suitable combination. Conversely, although the computer workstation may be described herein in the context of separate embodiments for clarity, it may also be implemented in a single embodiment. Reference in the specification to "some embodiments", "an embodiment", "one embodiment" or "other embodiments" means that a particular feature, structure, or characteristic described in connection with the embodiments is included in at least some embodiments, but not necessarily all embodiments.

It is to be understood that the phraseology and terminology employed herein is not to be construed as limiting and are for descriptive purpose only. The principles and uses of the teachings of the present invention may be better understood with reference to the accompanying description, figures and examples. It is to be understood that the details set forth herein do not construe a limitation to an application of the invention.

Furthermore, it is to be understood that the invention can be carried out or practiced in various ways and that the invention can be implemented in embodiments other than the ones outlined in the description above. It is to be understood that the terms "including", "comprising", "consisting" and grammatical variants thereof do not preclude the addition of one or more components, features, steps, or integers or groups thereof and that the terms are to be construed as specifying components, features, steps or integers. If the specification or claims refer to "an additional" element, that does not preclude there being more than one of the additional element. It is to be understood that where the claims or specification refer to "a" or "an" element, such reference is not to be construed that there is only one of that element. It is to be understood that where the specification states that a component, feature, structure, or characteristic "may", "might", "can" or "could" be included, that particular component, feature, structure, or characteristic is not required to be included.

The descriptions, examples, methods and materials presented in the claims and the specification are not to be construed as limiting but rather as illustrative only. Meanings of technical and scientific terms used herein are to be commonly understood as by one of ordinary skill in the art to which the invention belongs, unless otherwise defined. It will be appreciated that the methods described herein may be performed in the described order, or in any suitable order.

In accordance with one aspect, the present description concerns a computer workstation. The computer workstation may be used in any type of application requiring mounting computer monitors in front of a sitting user. Even though the present description focuses on the use of the disclosed computer workstation with computer monitors, it is understood that the computer workstation could also be used to mount other types of monitors, monitors that are operated or not by any type of computerized device, and the like. Accordingly, to alleviate the present description, the term "computer workstation" may be referred to as "workstation".

Figure 9:
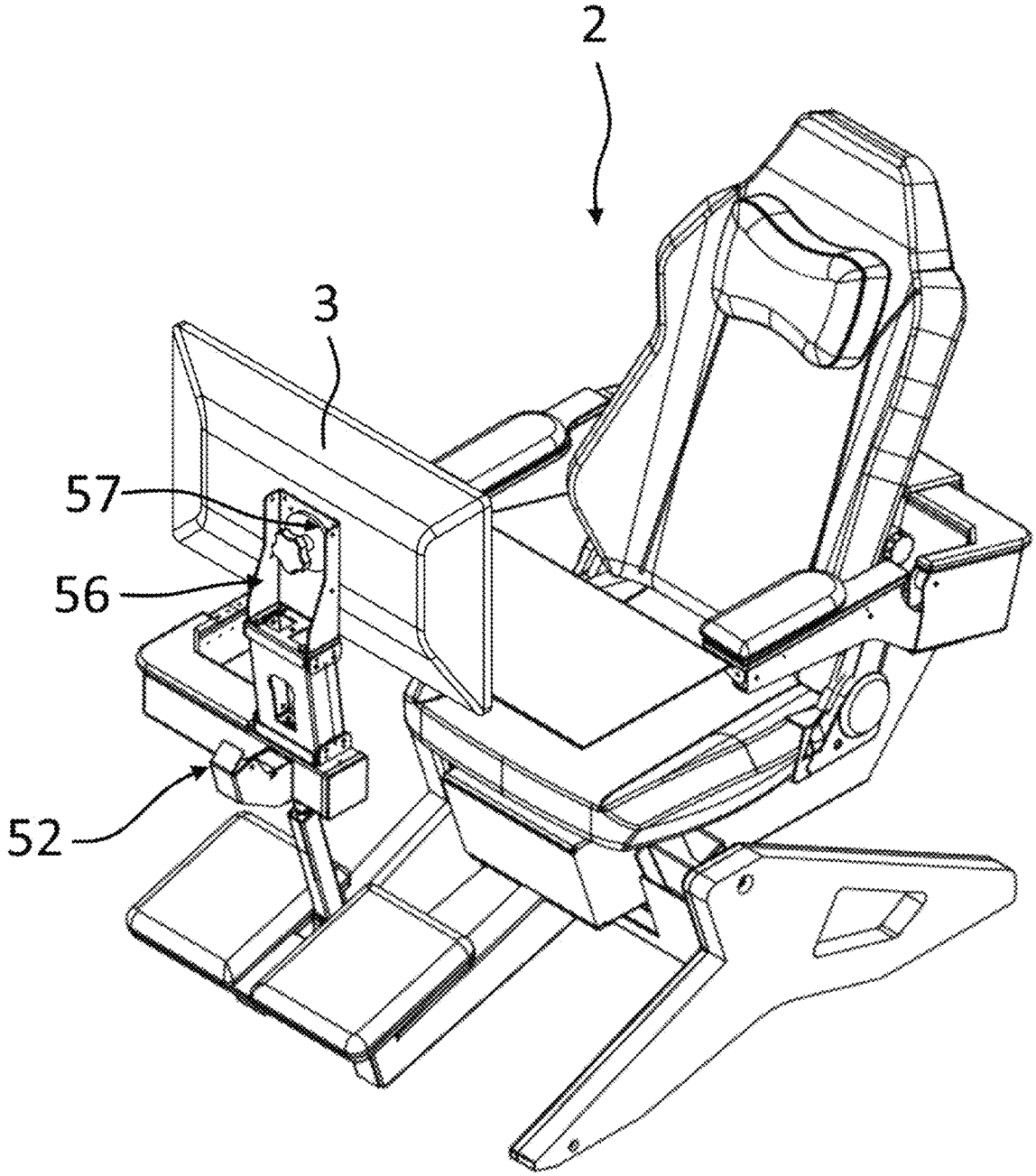
FIG. 9 is a front and top perspective view of the computer workstation of FIG. 1 supporting a monitor.
Figure 10:
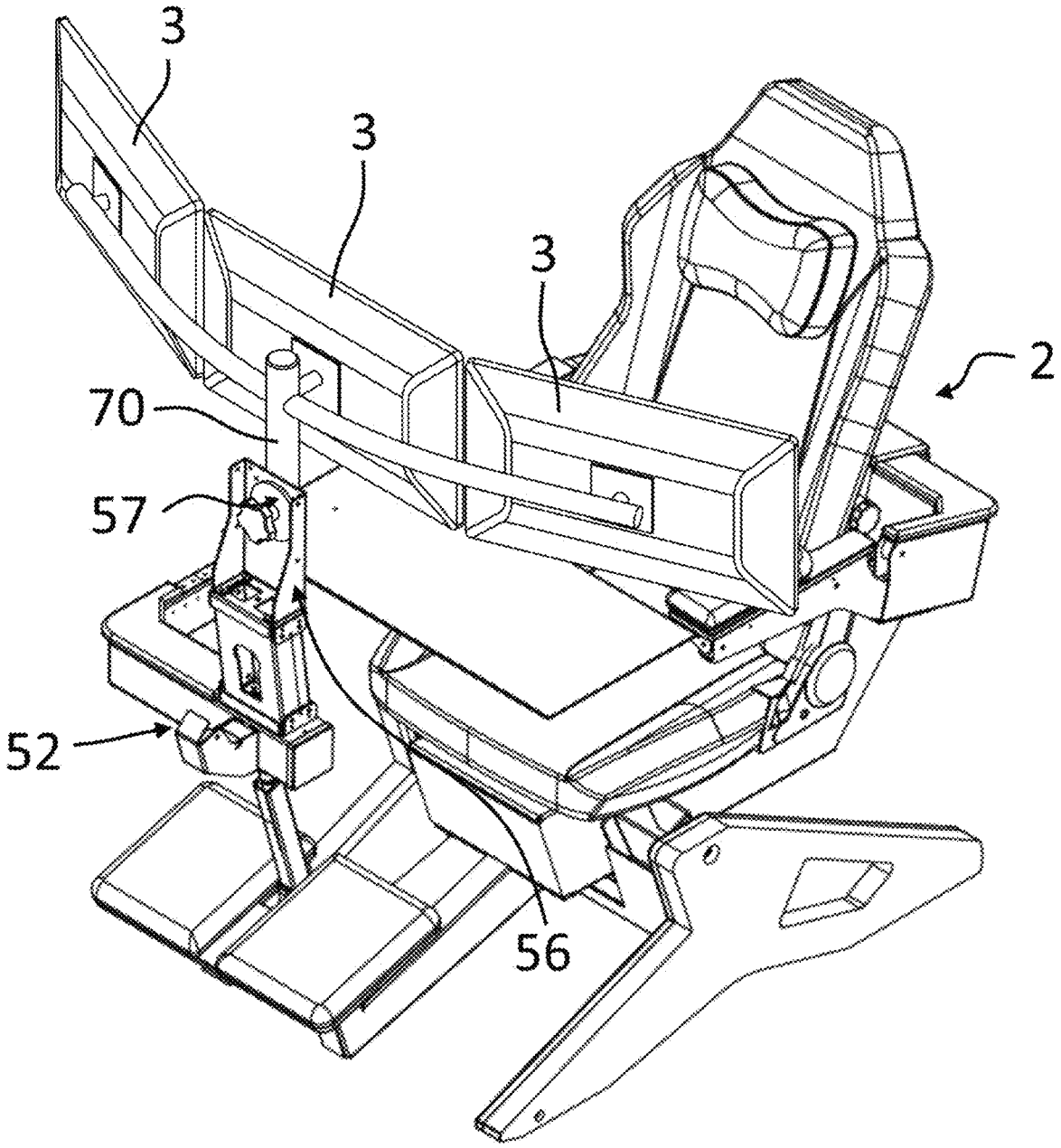
FIG. 10 is a front and top perspective view of the computer workstation of FIG. 1 supporting an external monitor mount and three monitors.

Referring now to FIGS. 1 to 8, an embodiment of a workstation 2 is shown. The workstation 2 is configured to support one or more computer monitors 3, as shown in FIGS. 9 and 10, in front of a sitting user (not shown). In typical embodiments, the workstation 2 allows the user to perform computer tasks from a computer while in a comfortable sitting position and visualize the outcome of these computer tasks on the one or more supported computer monitors. It will be readily understood that the use of the workstation 2 is not limited to performing computer tasks for professional purposes but may also be used for educational or school-related work or recreational purposes.

Referring more particularly to FIG. 1, the computer workstation 2 includes a user chair 4, on which the user may sit. The chair 4 may be any chair known in the art and may be mounted to the workstation 2 with any means known in the art. The chair 4 may be temporarily mounted or permanently mounted to other components of the workstation 2. In some implementations, the chair 4 includes a seat 5 and may further include a backrest 6. In the embodiment shown, the chair 4 is an ergonomic chair having a seat 5 and a backrest 6 pivotable about the seat 5.

The workstation 2 also includes a frame 8. The frame 8 may be embodied by an assembly of components rigidly affixed together and may include articulated or otherwise movable members. It will be readily understood by one skilled in the art that the frame 8 may have any structure suitable to support the chair 4, the user sitting on the chair, the one or more monitors and any other object the user may reasonably wish to have supported by the workstation 2. The embodied frame 8 includes: a lower frame section 12, a support arm 22, and an upper frame section 14. Understandably, other embodiments may include more frame sections.

The lower frame section 12 is configured to stand on a ground surface (or a floor) and support the user chair 4. The lower frame section 12 may only support the seat 5 of the chair 4, or may alternatively support the seat 5 and the backrest 6 of the chair 4. The lower frame section 12 may include a pivotable section to allow the chair 4 to pivot over the ground which may coincidentally and similarly lead to pivoting the user sitting on the chair 4. In the non-limitative embodiment shown, the lower frame section 12 includes a first subsection 10, also referred to as base subsection, resting on the ground and a second subsection 13, also referred to as dynamic subsection, also referred to as dynamic subsection, pivotally mounted to and pivotable about the first subsection 10. In an alternative embodiment to allow the chair 4 to be pivotable over the floor, the lower frame section 12 may have a single subsection, such as the dynamic subsection 13, having a curved bottom surface configured to roll on the ground.

Referring to FIGS. 1 to 6 and 8, the base subsection 10 includes two vertically arranged feet 16, 16' separated from one another by a spacing width which may correspond to the width of the dynamic subsection 13. The feet 16, 16' may be secured to one another with a beam 18, bar, rod, or the like. The base subsection 10 rests on the ground and may thus support directly or indirectly the weight of every other component of the workstation 2. In the non-limitative embodiment shown, the embodied feet 16, 16' each substantially have the shape of a triangle; however, they may be of any other shape known in the art in other embodiments. The dynamic subsection 13, best shown in FIGS. 1 to 4, 6 and 8, is embodied in the form of a trapezoidal prism; however, it may have any other shape known in the art. The dynamic subsection 13 is pivotally connected to the base subsection 10 through a pivot shaft 20 spanning the width of the workstation 2 and going through upper extremities of each of the foot 16, 16'.

Figure 3:
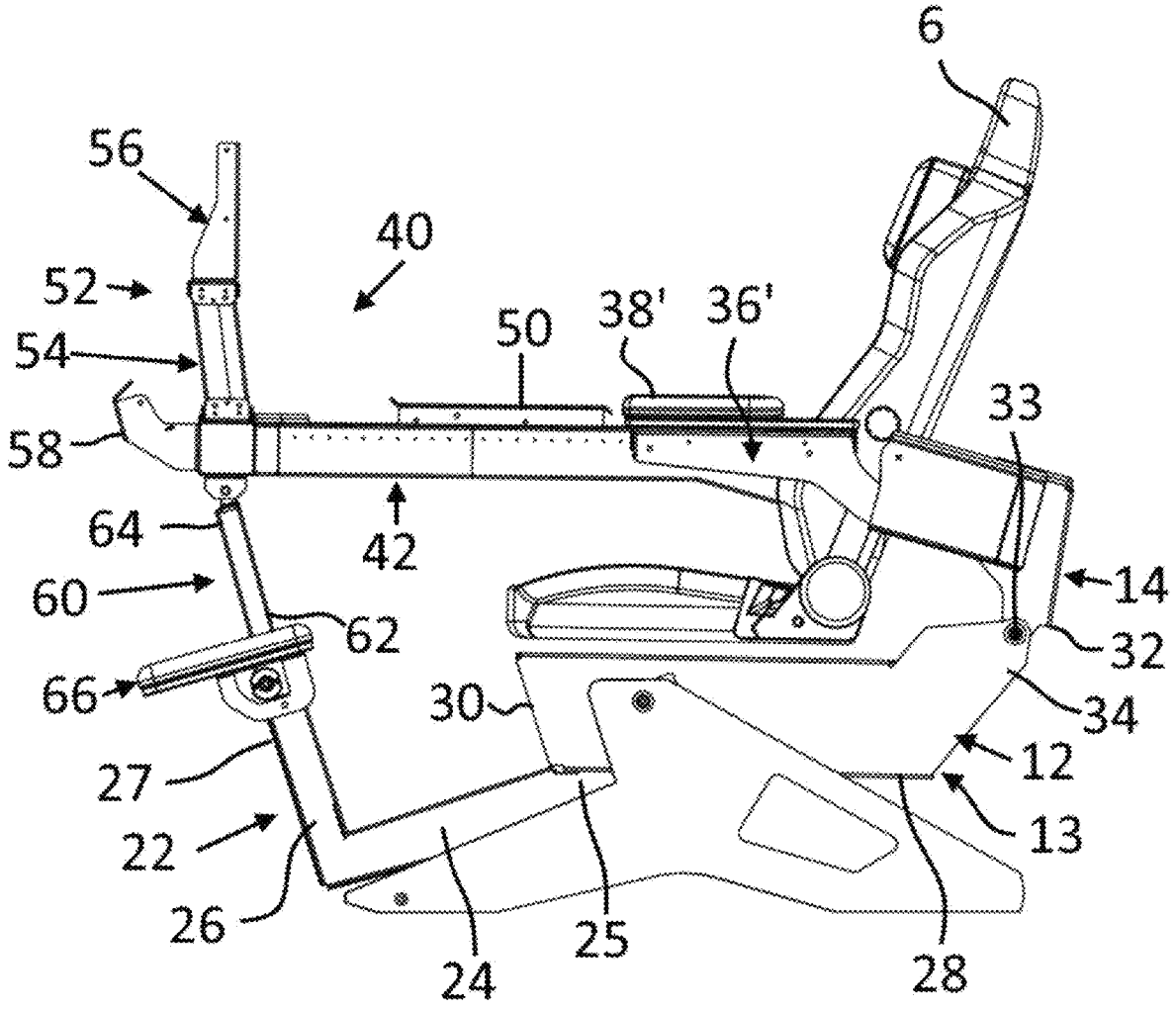
FIG. 3 is a left side elevation view of the computer workstation of FIG. 1.
Figure 4:
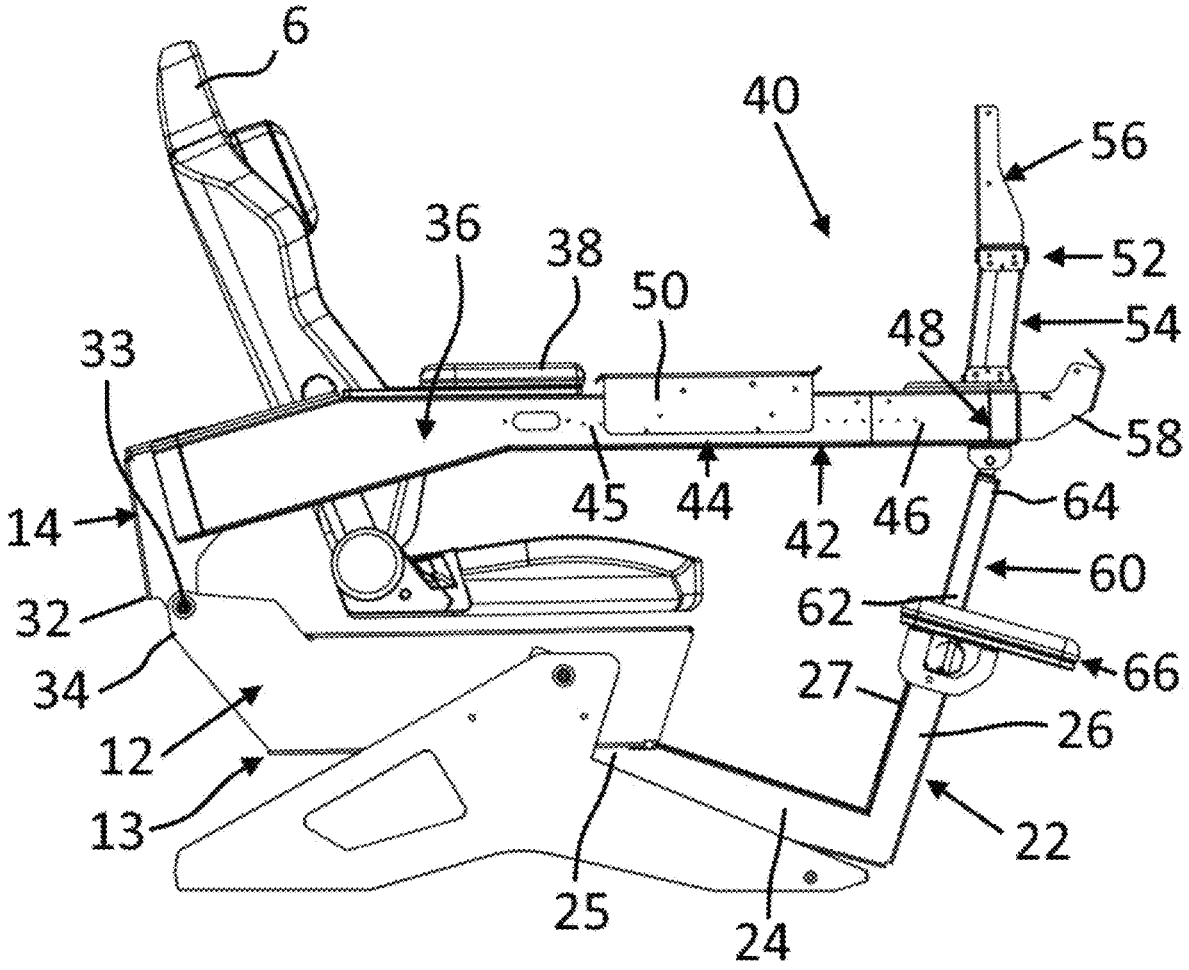
FIG. 4 is a right side elevation view of the computer workstation of FIG. 1.

As best seen on FIGS. 3 and 4, the frame 8 further includes a support arm 22. In the illustrated embodiment, the support arm 22 projects from the lower frame section 12, for example from the dynamic subsection 13, towards the front of the workstation 2, from the perspective of a user sitting on the chair. The support arm 22 may have the form of an "L-shaped" beam and may thus include a first segment 24 projecting substantially horizontally in front of the lower frame section 12 and a second segment 26 projecting substantially vertically and upwardly from a distal end 27 of the first segment 24. The support arm 22 may be connected to the lower frame section 12 at a proximal end 25 of the support arm 22, either to a bottom surface 28 of the dynamic subsection 13, a front surface 30 of the dynamic subsection 13, or a combination thereof. The distal end 27 of the support arm 22 may project forwardly of the chair 4. In other embodiments, not shown, the support arm 22 may include more segments and may have any other suitable shape known in the art. In the illustrated embodiment, the support arm 22 projects substantially centrally to the width of the workstation 2, although in other embodiments it may be offset on either side of the same. The embodied support arm 22 is fixedly connected to the lower frame section 12, although in other embodiments, not shown, the support arm 22 may be pivotally connected to the lower frame section 12. In such embodiments wherein the support arm 22 is pivotally connected to the lower frame section 12, pivoting may be restricted or unrestricted upon actuation of a switch, a lock, a clamp, or any other actuation mechanism known in the art. It will be appreciated that pivot of the dynamic subsection 13 relative to the base subsection 10 may coincidentally and similarly pivot the support arm 22.

Referring now to FIGS. 2 to 4 and 6, the frame 8 includes an upper frame section 14 pivotable about the lower frame section 12, for example about the dynamic subsection 13. Accordingly, the upper frame section 14 may be pivotally connected at a pivotable beam 33 defining a pivot axis. The pivotable beam 33 may span the width of the workstation 2 and pass through a lower extremity 32 of the upper frame section 14 and through an upper rear extremity 34 of the dynamic subsection 13. The backrest 6 of the chair 4 may be temporarily or permanently mounted to the upper frame section 14. Hence, the pivot of the upper frame section 14 about the lower frame section 12 may coincidentally and similarly pivot the backrest 6 of the chair 4. In an alternative embodiment, the backrest 6 of the chair 4 may be unmounted from the upper frame section 14 and each of the two may pivot independently from the other.

The frame 8 further includes an armrest 36 mounted to the upper frame section 14. The embodied workstation 2 of FIG. 1 includes two armrests 36, 36' projecting respectively from a left or right side of the upper frame section 14 and deviating forwardly with regards to the sitting user. It will however be understood that in some variants the computer workstation may include a single armrest 36 configured to support the one or more computer monitor, as explained below. The armrests 36, 36' may be positioned at a height allowing a user sitting on the chair 4 to rest his or her arms. The embodied armrests 36, 36' are fixedly connected to the upper frame section 14 such that pivot of the same will result in coincidental and similar pivot of the armrests 36, 36'. In other embodiments, the armrests 36 may be pivotally connected to the upper frame section 14. In some implementations, the armrests 36, 36' may include articulated components allowing the user to customize the configuration of the armrests 36, 36' to his or her anatomy and/or preferences. The armrests 36 may further include pads 38, 38' configured to cushion the resting of the users' arms. It will be appreciated that in embodiments with two armrests 36, 36', the armrests 36, 36' may have the same or a different length and/or shape. In yet other embodiments, one or both of the armrests 36 may be connected to the chair 4.

Still referring to FIG. 1, the workstation 2 further includes a monitor stand assembly 40 configured to support one or more computer monitors in front of a user sitting on the chair 4. The monitor stand assembly 40 is positionally adjustable relative to the lower frame section 12 and therefore with regards to the user sitting on the chair 4. The monitor stand assembly 40 may therefore be displaced upwardly, downwardly, laterally and/or pivotably with regards to the lower frame section 12, the armrests 36, 36', and/or the user sitting on the chair 4. The monitor stand assembly 40 includes an armrest extension 42, a monitor mount 52 and a brace 60. It will be appreciated that the armrest extension 42 and the brace 60 are configured to support the weight of the monitor mount 52, and mounted monitors thereof, while simultaneously allowing adjustment of the position of the monitor mount 52 in front of the user.

Figure 7:
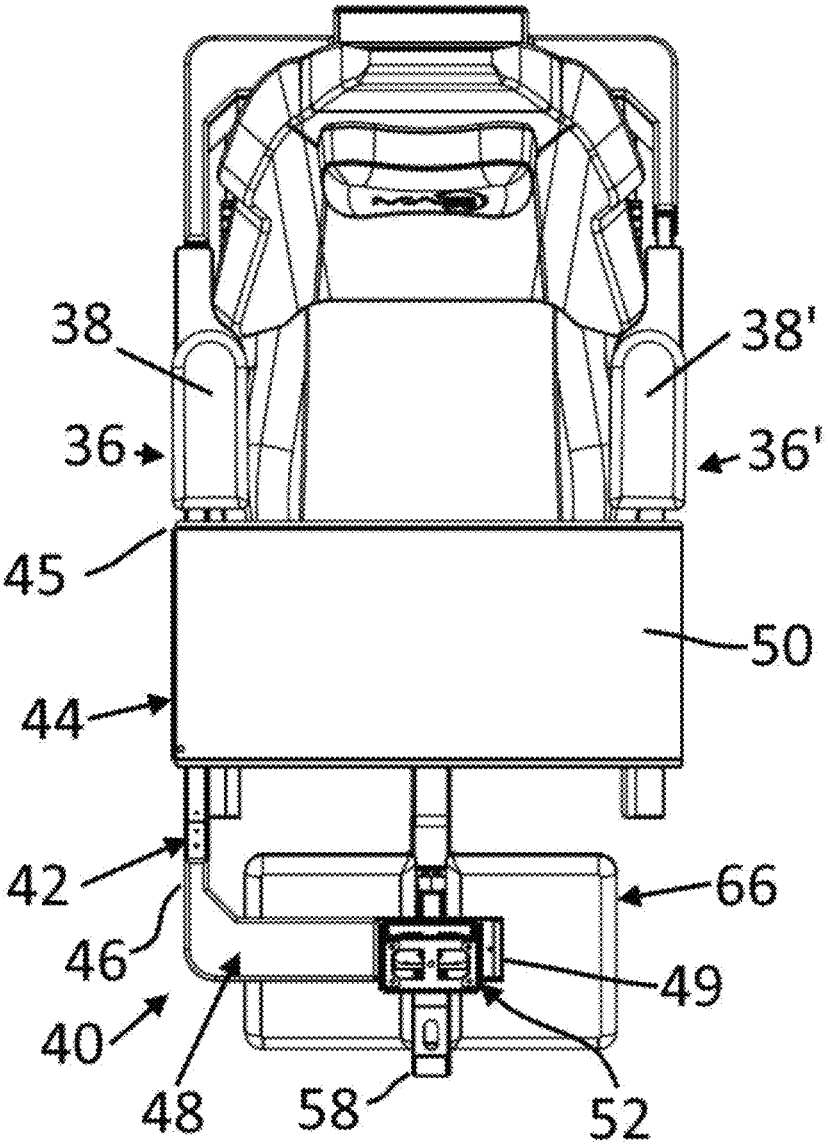
FIG. 7 is a top plan view of the computer workstation of FIG. 1.
Figure 8:
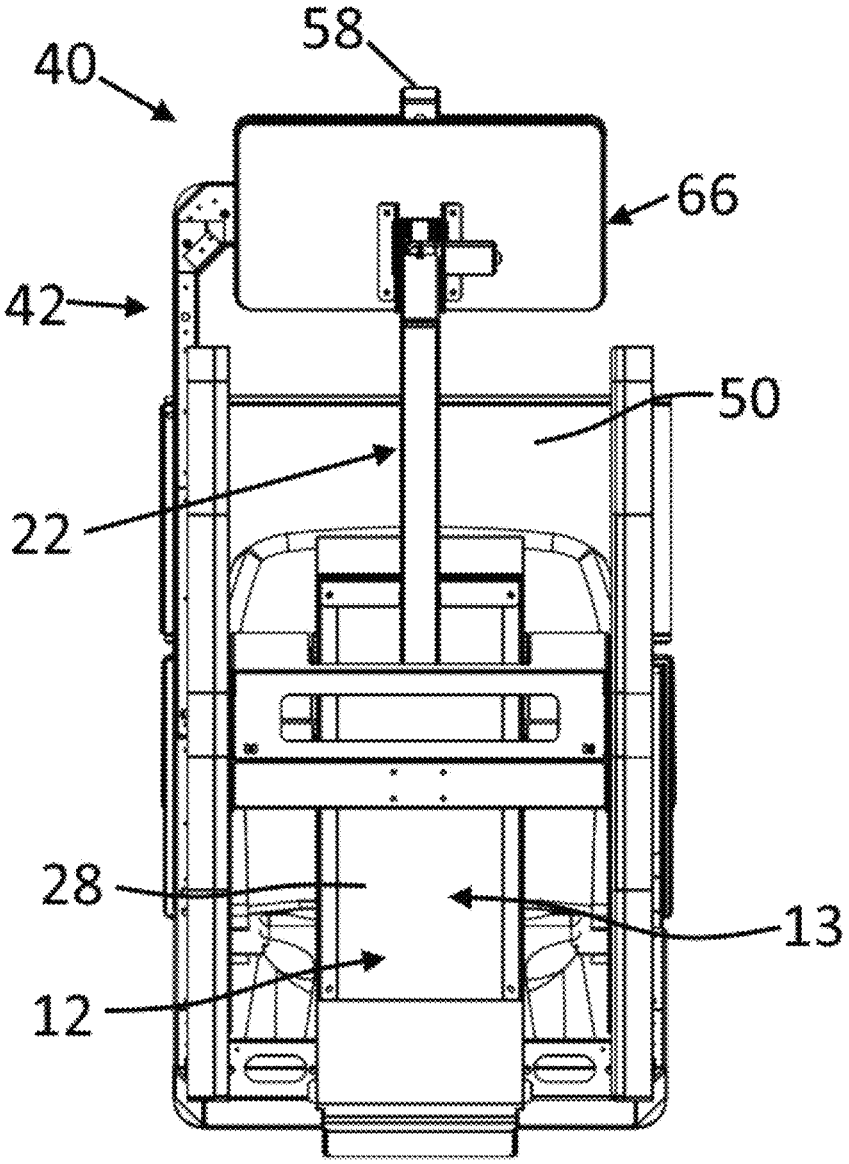
FIG. 8 is a bottom plan view of the computer workstation of FIG. 1.

Referring now to FIGS. 1 and 7, the armrest extension 42 projects forwardly from one of the armrests 36. The armrest extension 42 may include two or more members. In the embodiment shown, a first armrest extension member 44 projects forwardly from a proximal end 45 of the armrest 36, and a second armrest extension member 48 projects from a distal end 46 of the first armrest extension member 44, towards the center of the workstation 2 and widthwise of the workstation 2. The armrest extension 42 may hence have an "L-shape" allowing for an extremity 49 of the armrest extension 42 to be positioned in front and centrally, widthwise, of a user sitting on the chair 4. In some embodiments, the armrest extension 42 may be pivotally connected to the armrest 36 and/or the armrest extension members 44, 48 may be pivotally connected to one another. In some embodiments, the armrest extension 42 and/or its two or more members 44, 48 may be telescopic. In some embodiments, the armrest extension may include a single armrest extension member 42 angled or curved towards the front and center, widthwise, of the workstation 2. It may be understood that pivot of the upper frame section 14 may coincidentally and similarly pivot the armrest extension 42. In other implementations, the armrest extension 42 may project from the frame 8, and more specifically from the lower frame section 12. For instance, the armrest extension 42 can be mounted to the lower frame section 12 via a rotatable connection and therefore can pivot about the lower frame section 12.

In some implementations, the armrest extension 42 may further include a table 50. The table 50 may be affixed over the armrest extension 42, such as onto the first armrest extension subsection 44 projecting from the armrest 36, and may project in front of the user sitting on the chair 4, partially or fully along the width of the workstation 2. In some variants, the table may be supported on both sides of the chair 4 by the two armrests 36, 36'. In some embodiments, the table 50 may be pivotable in any direction to free up space in front of the chair 4 to allow passage of the user to and from the seat 5 of the workstation 2. The table 50 may be configured to support a keyboard connected to a computer. Understandably, the table 50 may have any other shape known in the art.

Figure 5:
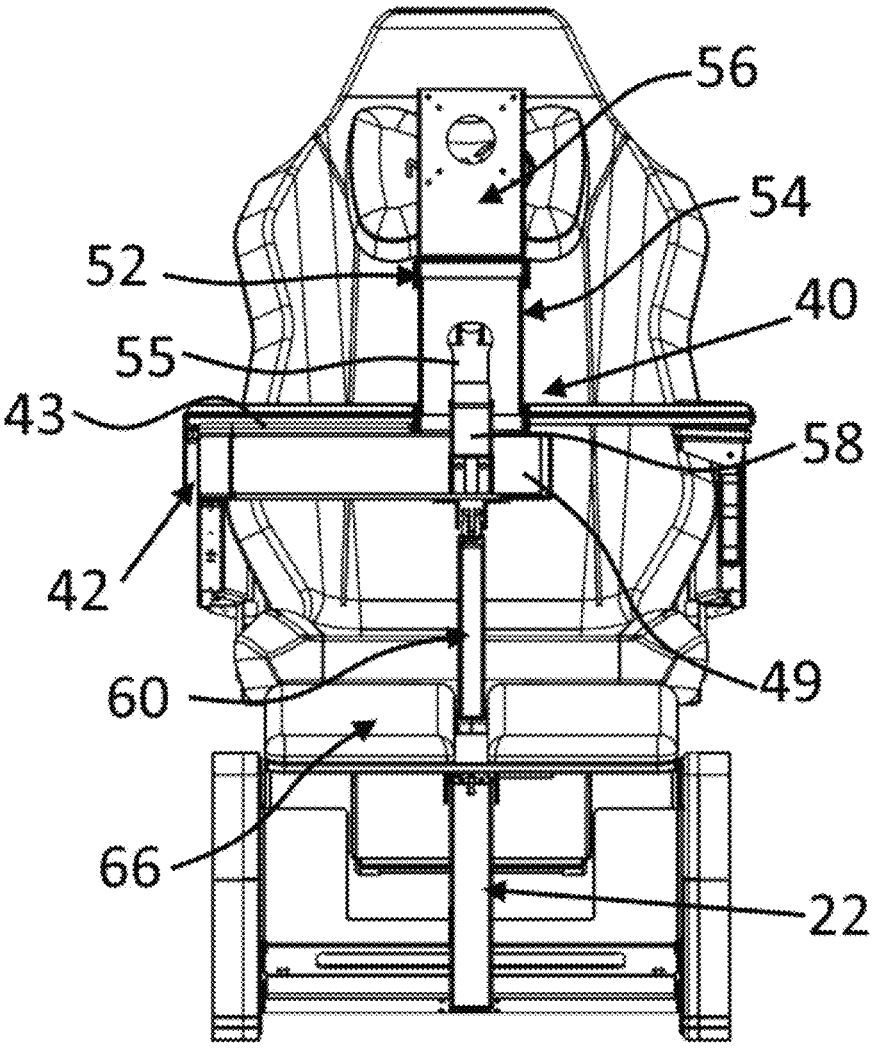
FIG. 5 is a front elevation view of the computer workstation of FIG. 1.
Figure 6:
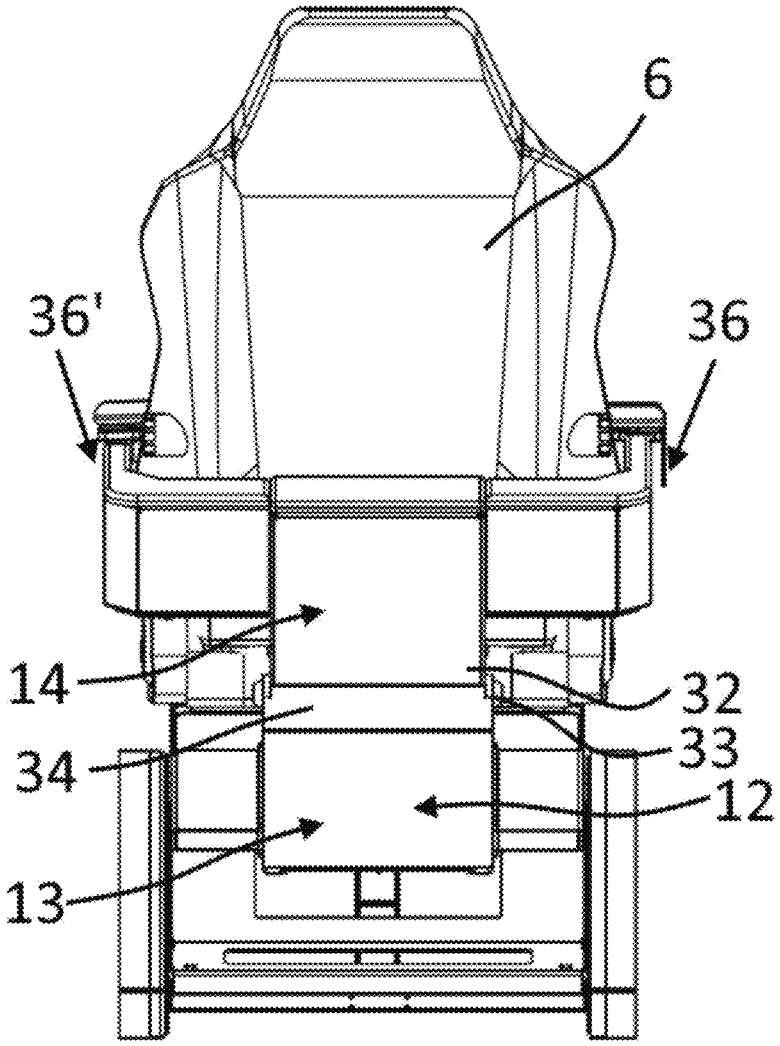
FIG. 6 is a rear elevation view of the computer workstation of FIG. 1.

Referring now to FIGS. 1 and 5, the workstation 2 includes a monitor mount 52 affixed onto the armrest extension 42 and configured to support the one or more computer monitors. In the implementation shown, the monitor mount 52 is placed on the armrest extension 42 in front and centrally, widthwise, of a user sitting on the chair 4. The monitor mount 52 includes a stand 54 projecting upwardly from the armrest extension 42 and, more particularly, from a top surface 43 of the armrest extension 42. The monitor mount further includes a monitor support 56 connected to the stand 54. The monitor support 56 may directly receive and secure one monitor 3, as shown in FIG. 9, or it may receive and secure external monitor mounts 70 for mounting one or a plurality of the monitors 3, as shown in FIG. 10. The monitor support 56 may therefore include a hole 57 for receiving and engaging with a fastener of the monitor 3 or of the external monitor mount 70. The stand 54 may be pivotable relative to the armrest extension 42. The monitor support 56 may be pivotable relative to the stand 54. In embodiments wherein the stand 54 is pivotable relative to the armrest extension 42, such as in the implementation of FIGS. 1 and 5, the monitor mount 52 may further include a hook 58 connected to the armrest extension 42. Upon pivot of the stand 54 with regard to the armrest extension 42, the hook 58 may be received in an aperture 55 of the stand 54 to temporarily lock the stand 54 in a locked position. The hook 58 may be placed anywhere on the extension arm 42 that allows locking with the aperture 55 of the pivoting stand 54. Understandably, any other locking mechanism may be used to temporarily lock the pivoting stand 54 at a predetermined position. Furthermore, displacing and/or locking the stand 54 may be realized with other adjustment mechanisms, such as manual adjustment mechanisms or electromechanical adjustment mechanisms. For example, in an implementation, a handle operable by the user may be used to actuate a locking mechanism, such as pins received by corresponding apertures, to lock or unlock the stand 54 in a given position. In another implementation, an electric actuator may lock or unlock the stand 54 in a given position; the electric actuator being actuated by the press of a button or the flip of a switch, for example. It will be understood that other types of mechanisms known in the art may be used to displace, lock and unlock the stand 54 in a given position.

Referring now to FIGS. 3 and 4, the monitor stand assembly 40 further includes the brace 60 having a first extremity 62 pivotally mounted to the distal end 27 of the support arm 22 and a second extremity 64 pivotally mounted to the armrest extension 42. The brace 60 may be mounted to the armrest extension 42 directly, or at least substantially directly, under the monitor mount 52, such that the weight of the monitor mount 52 may be directly supported by the brace 60. In an embodiment, the monitor mount 52 and the brace 60 are substantially vertically aligned. The brace 60 may therefore support the weight of the monitor mount 52 in compression with the shear, torsion and/or bending stresses applied to the same being substantially limited. The weight of the monitor mount 52 and the one or more monitors may thus be supported by a combination of the brace 60 and of the armrest extension 42. The embodied brace 60 has the shape of a beam, however in other embodiments, it may have any other shape known in the art. Although the brace 60 illustrated herein is a monolithic component, in other embodiments the brace may have a plurality of components assembled together, in a rigid or articulated manner. In some embodiments, the brace 60 may be telescopic with any means known in the art. For example, the brace 60 may include a male subsection slideable into a female subsection, not shown. The subsections of the brace 60 may be telescopic due to manually actuated displacement, hydraulic actuated displacement, electro-mechanical actuated displacement, or any other actuation displacement mechanism known in the art.

Referring back to FIG. 1, the workstation 2 may further include a footrest 66 configured to support feet of a user sitting on the chair 4. The footrest 66 may be connected to the support arm 22 or may project from the lower frame section 12. In the non-limitative embodiment shown, the embodied footrest 66 includes two substantially horizontal panels 68, 68'; each of the two panels 68, 68' being configured to support a foot of the user. The footrest 66 may be pivotally connected to the support arm 22 to allow the user to customize support of its feet. In some embodiments, the two panels 68, 68' may be independently pivotable relative to one another. The footrest 66 may be temporarily or permanently connected to the workstation 2. It may be understood that the footrest 66 may have any other shape known in the art.

Upon reading of the above description, it will be readily understood and appreciated that the monitor mount 52, and the monitors that are mounted thereon, may be positionally adjusted relative to a user sitting on the workstation's chair 4 without disrupting the support offered by the armrest extension 42 and the brace 60. For example, upward or downward pivot of the upper frame section 14 of the workstation 2 may result in upward or downward pivot of the armrest extension 42 and thereof of the monitor mount 52 with regards to the user sitting on the chair 4. The brace 60 may pivot with regards to the support arm 22 and/or to the armrest extension 42 to allow pivot of the monitors relative to the sitting user. In some variants the brace 60 may extend or compress, in embodiments where it is telescopic, to further allow adjustment of the monitor mount 52 with regards to the seat 5 of the user. The armrest extension 42 may also be telescopic to further allow positional adjustment of the monitor mount 52 with regards to the sitting user. Although the monitor mount 52 is presented being in front and in the center, widthwise, of the user sitting on the chair 4, it may be displaced in various positions in front of the sitting user. Understandably, positional adjustment of the monitor mount 52 may be realized with constant direct support from the brace 60 under said monitor mount 52 and with constant support from the armrest extension 42.

Several alternative embodiments and examples have been described and illustrated herein. The embodiments of the invention described above are intended to be exemplary only. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind. The scope of the invention is therefore intended to be limited solely by the scope of the appended claims.

The invention claimed is:

1. A computer workstation for supporting one or more computer monitors in front of a sitting user, comprising:
- a frame, comprising:
  - a lower frame section configured to support a user chair; and
  - a support arm having a proximal end connected to the lower frame section and a distal end projecting forward of the user chair; and
- a monitor stand assembly positionally adjustable relative to the lower frame section, comprising:
  - an armrest extension projecting from the frame;
  - a monitor mount affixed onto the armrest extension and configured to support the one or more computer monitors; and
  - a brace having a first extremity mounted to the distal end of the support arm and a second extremity mounted to the armrest extension directly under the monitor mount, wherein at least one of the brace and the support arm is telescopic.

2. The computer workstation of claim 1, wherein the monitor stand assembly is positionally adjustable relative to the lower frame section in at least one of: upwardly, downwardly, laterally, and rotatably.

3. The computer workstation of claim 1, wherein the support arm comprises a first segment projecting substantially horizontally forward of the lower frame section and a second segment projecting substantially vertically and upwardly from the first segment.

4. The computer workstation of claim 1, wherein the support arm projects centrally widthwise of the user chair.

5. The computer workstation of claim 1, wherein the proximal end of the support arm is pivotally connected to the lower frame section.

6. The computer workstation of claim 1, wherein the armrest extension comprises a first armrest extension member projecting forwardly from a proximal end and a second armrest extension member projecting from a distal end of the first armrest extension member towards a center widthwise of the user chair.

7. The computer workstation of claim 6, wherein at least one of the first armrest extension member and the second armrest extension member is telescopic.

8. The computer workstation of claim 1, further comprising a table mounted to the armrest extension and projecting in front of the user sitting on the user chair.

9. The computer workstation of claim 1, wherein the monitor mount comprises a stand projecting upwardly from the armrest extension and a monitor support connected to the stand and configured to support the one or more computer monitors.

10. The computer workstation of claim 9, wherein at least one of the stand is pivotable about the armrest extension and the monitor support is pivotable about the stand.

11. The computer workstation of claim 10, wherein the stand is configurable into a locked position, and wherein at least one of the monitor mount and the stand further comprises a locking mechanism to configure the stand in the locked position.

12. The computer workstation of claim 11, wherein the locking mechanism comprises one of: a hook connected to the armrest extension and an aperture defined in the stand, the hook being configured to engage with the aperture defined in the stand to configure the stand in the locked position, a handle operable by the user and configured to actuate pins engageable into corresponding apertures defined in the stand to configure the stand in the locked position, and an electric actuator configured to configure the stand in the locked position when actuated by the user.

13. The computer workstation of claim 1, wherein the brace is telescopic.

14. The computer workstation of claim 1, further comprising a footrest connected to at least one of the support arm and the lower frame section.

15. The computer workstation of claim 1, wherein the monitor mount and the brace are substantially vertically aligned.

16. The computer workstation of claim 1, wherein a weight of the monitor mount and of the supported one or more monitors is fully supported by a combination of the armrest extension and the brace.

17. A computer workstation for supporting one or more computer monitors in front of a sitting user, comprising:

a user chair;

a frame, comprising:

a lower frame section supporting the user chair;

a support arm having a proximal end connected to the lower frame section and a distal end projecting forward of the user chair; and an upper frame section mounted to the lower frame section;

an armrest mounted to the upper frame section; and a monitor stand assembly positionally adjustable relative to the lower frame section, comprising:

an armrest extension projecting from at least one of the armrest and the lower frame section;

a monitor mount affixed onto the armrest extension and configured to support the one or more computer monitors; and a brace having a first extremity mounted to the distal end of the support arm and a second extremity mounted to the armrest extension directly under the monitor mount, wherein at least one of the first extremity and the second extremity of the brace is pivotally mounted to the distal end of the support arm or to the armrest extension respectively.

18. The computer workstation of claim 17, wherein the lower frame section is supported by a ground surface and the upper frame section is pivotally mounted to the lower frame section.

19. The computer workstation of claim 18, wherein the lower frame section further comprises a base subsection resting on the ground surface and a dynamic subsection supporting the user chair and pivotable about the base subsection.

20. The computer workstation of claim 19, wherein the support arm projects from the dynamic subsection.

* * * * *